US009252516B2

(12) United States Patent
Ashibu

(10) Patent No.: US 9,252,516 B2
(45) Date of Patent: Feb. 2, 2016

(54) CONNECTOR

(71) Applicant: Japan Aviation Electronics Industry, Limited, Tokyo (JP)

(72) Inventor: Kenta Ashibu, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 21 days.

(21) Appl. No.: 14/041,543

(22) Filed: Sep. 30, 2013

(65) Prior Publication Data

US 2014/0113462 A1 Apr. 24, 2014

(30) Foreign Application Priority Data

Oct. 22, 2012 (JP) ..... 2012-232519

(51) Int. Cl.
*H01R 12/77* (2011.01)
*H01R 12/79* (2011.01)
*H01R 12/88* (2011.01)

(52) U.S. Cl.
CPC ..... *H01R 12/79* (2013.01); *H01R 12/77* (2013.01); *H01R 12/88* (2013.01)

(58) Field of Classification Search
CPC ..... H01R 12/24; H01R 12/08; H01R 12/77; H01R 12/79; H01R 12/57; H01R 14/028; H01R 12/88; H01R 12/78; H01R 12/775; H01R 12/59; H01R 12/592
USPC ..... 439/260, 494, 495, 492, 499, 326–329, 439/67, 752, 595
See application file for complete search history.

(56) References Cited

U.S. PATENT DOCUMENTS

| | | | | |
|---|---|---|---|---|
| 7,083,455 | B1 * | 8/2006 | Miura et al. | 439/260 |
| 7,172,446 | B1 * | 2/2007 | Hashimoto et al. | 439/260 |
| 7,527,511 | B1 * | 5/2009 | Peng et al. | 439/260 |
| 8,075,328 | B2 * | 12/2011 | Ashibu | 439/260 |
| 2006/0160390 | A1 | 7/2006 | Miura et al. | |
| 2007/0049087 | A1 | 3/2007 | Hashimoto et al. | |
| 2015/0118909 | A1 * | 4/2015 | Yokoo | 439/607.55 |

FOREIGN PATENT DOCUMENTS

| | | | |
|---|---|---|---|
| CN | 1808779 | A | 7/2006 |
| CN | 1929209 | A | 3/2007 |

(Continued)

OTHER PUBLICATIONS

Darfon—Integrated Components and Materials; Copyright: 2010 Darfon Corporation; Date of Printing: Nov. 21, 2014; http://www.darfon.com/english/MLCC_Application.asp.*

*Primary Examiner* — Amy Cohen Johnson
*Assistant Examiner* — Oscar C Jimenez
(74) *Attorney, Agent, or Firm* — Muncy, Geissler, Olds & Lowe, P.C.

(57) ABSTRACT

A connector includes a housing having an insertion section into which a connection end of a sheet-shaped connection target is inserted, and a plurality of contacts held by the housing so as to extend in an insertion direction of the connection target and be aligned along a direction across the insertion direction of the connection target, wherein each contact to be mounted by soldering on the top surface of the mounting board on a side of insertion of the connection target has at its end on the side of insertion of the connection target a surface of flat shape to be mounted on the top surface of the mounting board, and a sloping surface which is inclined at a predetermined angle of less than 90 degrees with respect to the surface to be mounted for guiding the connection end of the connection target to the insertion section.

7 Claims, 5 Drawing Sheets

(56) References Cited

FOREIGN PATENT DOCUMENTS

| | | | |
|---|---|---|---|
| JP | 2007-122894 | | 5/2007 |
| JP | 2011-181210 | | 9/2011 |
| KR | 1020090112555 | A | 10/2009 |
| KR | 1020110098645 | A | 9/2011 |

* cited by examiner

Conventional Art

CONNECTOR

BACKGROUND OF THE INVENTION

The present invention relates to a connector and in particular, to a connector adapted to connect sheet-shaped connection targets exemplified by FPCs (flexible printed circuits), FFCs (flexible flat cables) and the like.

As a connector of this type, for example, JP 2007-122894 A discloses a connector 81 as illustrated in FIG. 9. The connector 81 is fixed on a mounting board 82. When an actuator 86 is rotated with a connection end of a sheet-shaped connection target 85 being inserted into a recessed insertion section 84 of a housing 83, it establishes electrical connections between a plurality of connection terminals formed at the connection target 85 and a plurality of contacts 87 of the connector 81, and the connection target 85 is held by the connector 81.

However, since a bottom portion of the housing 83 is positioned under the insertion section 84 and the insertion section 84 is formed on the bottom portion, in order to insert the connection target 85 into the insertion section 84 of the connector 81, a connection end of the connection target 85 needs to be advanced toward the insertion section 84 in a state that the connection end of the connection target 85 is brought up from the top surface of the mounting board 82 to a predetermined height so as to be placed at a height of the insertion section 84. Thus, it has been difficult to smoothly perform an insertion operation of the connection target 85. If the connection target 85 is advanced toward the connector 81 along the top surface of the mounting board 82, the connection end of the connection target 85 collides against the bottom portion of the housing 83, whereby the insertion thereof is blocked.

In particular, a width of the connection target 85 of sheet shape increases with increasing number of pins and accordingly, a deflection tends to occur at the connection target 85. Consequently, it makes the insertion operation of the connection target 85 difficult and troublesome.

On the other hand, in a connector 88 disclosed by JP 2011-181210 A, a plurality of contacts 91 are each mounted by soldering on a solder pad 93 of a mounting board 92 under an entrance area of an insertion section 90 into which a connection target 89 is inserted, as illustrated in FIG. 10A. With this configuration, a lower portion of the insertion section 90 is not occupied by a bottom portion of a housing 94. But, under the entrance of the insertion section 90, the contacts 91 have upright ends 95 which stand substantially perpendicular to the top surface of the mounting board 92 and accordingly, a connection end of the connection target 89 needs to be advanced toward the insertion section 90 in a state that the connection end of the connection target 89 is brought up from the top surface of the mounting board 92 to a predetermined height so as to be placed at a height of the insertion section 90, as well as the connector 81 illustrated in FIG. 9. If the connection target 89 is advanced toward the connector 88 along the top surface of the mounting board 92, the connection end of the connection target 89 collides against the upright ends 95 of the contacts 91, whereby the insertion thereof is blocked.

Aside from that, in the connector 88, slopes 96 for guiding the insertion of the connection target 89 are formed at both side ends of the entrance of the insertion section 90, as illustrated in FIG. 10B.

However, the connection target 89 needs to be inserted after both side ends of the connection end of the connection target 89 are placed on the corresponding slopes 96. In the case where the connection target 89 is inserted obliquely with respect to the connector 88 so that the connection target 89 is inserted with one of both the side ends of the connection end of the connection target 89 being solely placed on the corresponding slope 96 of the housing 94, the connection end of the connection target 89 is caused to collide against some upright ends 95 of the contacts 91 at the other of both the side ends, and the connection target 89 is thus prevented from being properly inserted into the insertion section 90.

In addition, the housing 94 is generally produced by molding a resin material with an electrical insulation property. Since, due to the limitation of fabrication technology, it is difficult to form a sharply-peaked tip with such a material, a small upright end 97 standing substantially perpendicular to the top surface of the mounting board 92 is formed at an end of each slope 96 as illustrated in FIGS. 10A and 10B. Consequently, if the connection target 89 is tried to be inserted into the connector 88 along the top surface of the mounting board 92, both the side ends of the connection end of the connection target 89 collide against the upright ends 97 of the housing 94.

Furthermore, when each of the contacts 91 is soldered on the corresponding solder pad 93 on the mounting board 92, usually a solder fillet is formed and a slant constituted of a surface of the solder fillet is formed to extend from a surface of the solder pad 93 to the contact 91. However, the upright ends 95 of the contacts 91 are not necessarily all covered by the formed slants and, even if at least one of the upright ends 95 of the contacts 91 is exposed, still the connection target 89 collides against the exposed upright end 95 so that the connection target 89 cannot be smoothly inserted.

Thus, conventional connectors have a problem of difficulty in easy and smooth insertion of a sheet-shaped connection target.

SUMMARY OF THE INVENTION

The present invention has been made in order to solve the problems described above and an object of the present invention is to provide a connector capable of easy and smooth insertion of a sheet-shaped connection target.

A connector according to the present invention comprises a housing having an insertion section into which a connection end of a sheet-shaped connection target is inserted, and a plurality of contacts held by the housing so as to extend in an insertion direction of the connection target and be aligned along a direction across the insertion direction of the connection target, wherein each of the plurality of contacts to be mounted by soldering on a top surface of a mounting board on a side of insertion of the connection target includes at an end thereof on the side of insertion of the connection target a surface of flat shape to be mounted on the top surface of the mounting board, and a sloping surface which is inclined at a predetermined angle of less than 90 degrees with respect to the surface to be mounted for guiding the connection end of the connection target to the insertion section.

BRIEF DESCRIPTION OF THE DRAWINGS

FIGS. 1A to 1D are diagrams showing a connector according to a first embodiment of the present invention, in which FIG. 1A is a plan view, FIG. 1B is a front view, FIG. 1C is a side view, and FIG. 1D is a perspective view.

FIGS. 3A and 3B are diagrams showing a first contact used in the connector according to the first embodiment, in which FIG. 3A is a side view and FIG. 3B is a perspective view.

FIGS. 10A and 10B are diagrams showing another conventional connector, in which FIG. 10A is a cross-sectional view and FIG. 10B is a perspective view.

DETAILED DESCRIPTION OF THE INVENTION

First Embodiment

Figure 1A:
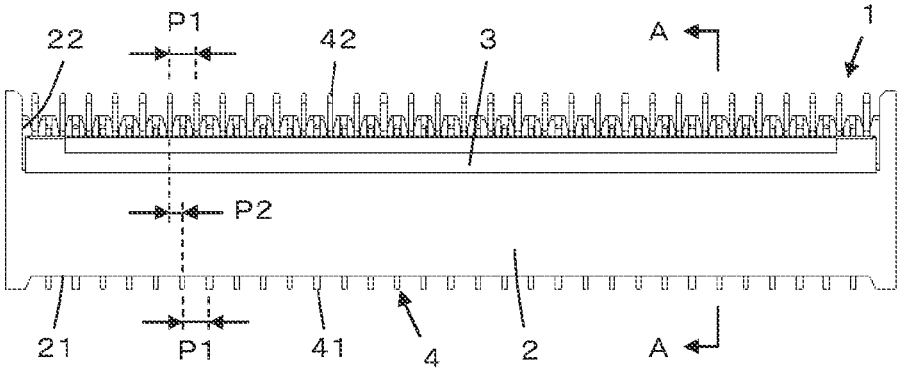
Figure 1B:
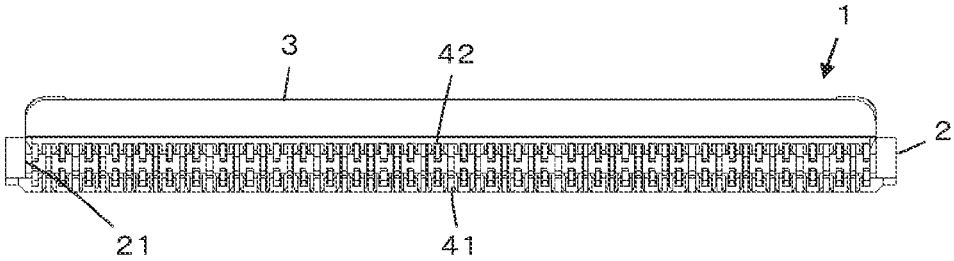
Figure 1C:
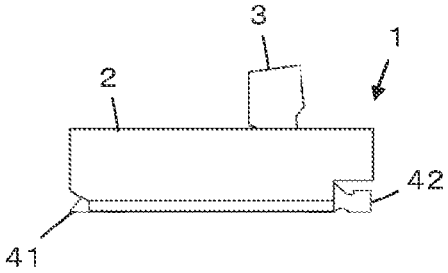
Figure 1D:
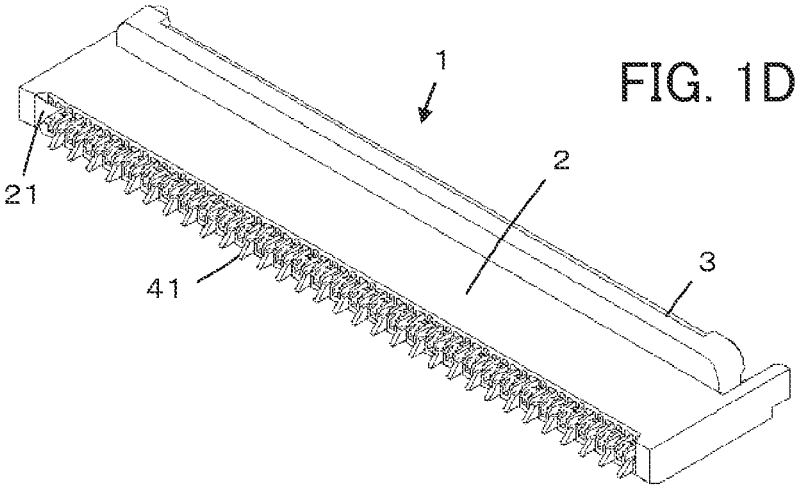

Hereinafter, a first embodiment of the present invention will be described based on accompanying drawings.

A structure of a connector 1 according to the first embodiment is illustrated in FIGS. 1A to 1D. The connector 1 is a compact connector adapted to connect a sheet-shaped connection target such as an FPC (flexible printed circuit) and an FFC (flexible flat cable) and comprises a housing 2, an actuator 3 rotatably attached to the housing 2, and a plurality of contacts 4 fixed to the housing 2.

The housing 2 has a front opening 21 that forwardly opens and a rear opening 22 that rearwardly opens. The rear opening 22 also upwardly opens. The actuator 3 is attached to the housing 2 to be rotated between an opening position where an upper side of the rear opening 22 is opened and a closing position where the upper side of the rear opening 22 is covered. FIGS. 1A to 1D show the state in which the actuator 3 is in the opening position, i.e., the rear opening 22 of the housing 2 is opened at its upper side.

When the actuator 3 is rotated into the closing position to cover the upper side of the rear opening 22 of the housing 2, it allows the housing 2 and the actuator 3 to have the outer shape of a substantially thin rectangular parallelepiped as a whole.

A plurality of slits which are parallel to each other are formed within the housing 2. Each slit pierces from the front opening 21 to the rear opening 22, and the contacts 4 are press-fitted and secured in the associated slits. The contacts 4 extend from the front opening 21 to the rear opening 22 in the front-back direction of the housing 2, and aligned in a width direction of the housing 2 perpendicular to the front-back direction.

The contacts 4 include first contacts 41 that are aligned at an arrangement pitch P1 so as to expose their front end portions through the front opening 21 of the housing 2, and second contacts 42 that are aligned at the same arrangement pitch P1 as that of the first contacts 41 so as to expose their rear end portions through the rear opening 22 of the housing 2. The first contacts 41 and the second contacts 42 are alternately aligned at an arrangement pitch P2 which is a half of the arrangement pitch P1.

Figure 2:
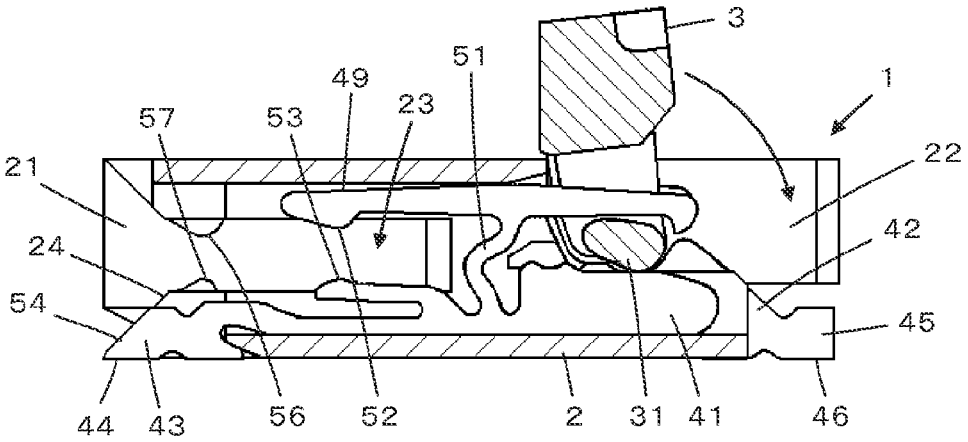
FIG. 2 is a cross-sectional view taken along line A-A of FIG. 1A.

As illustrated in FIG. 2, a front end portion 43 of the first contact 41 protrudes forward at the lower portion of the front opening 21 of the housing 2, and a surface 44 to be mounted of flat shape is formed at a bottom of the front end portion 43.

On the other hand, a rear end portion 45 of the second contact 42 protrudes rearward at the lower portion of the rear opening 22 of the housing 2, and a surface to be mounted 46 of flat shape is formed at a bottom of the rear end portion 45.

Figure 3A:
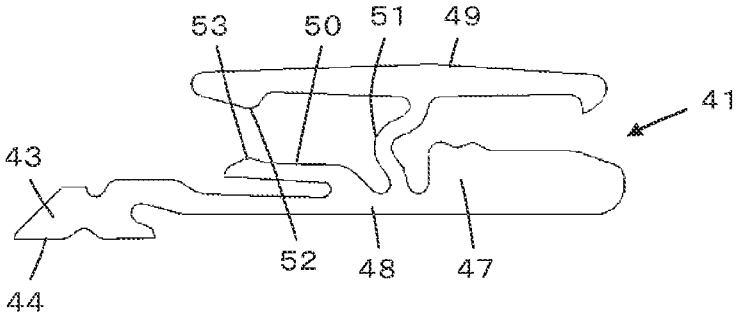
Figure 3B:
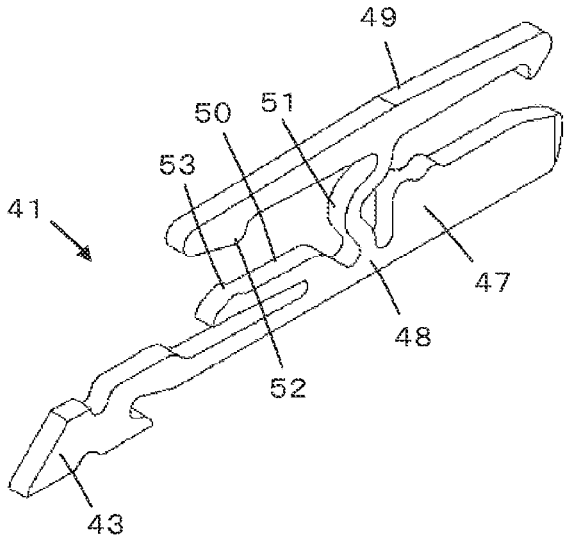

The first contact 41 is made of a flat metal member having conductivity and, as illustrated in FIGS. 3A and 3B, has a housing fixing portion 47 to be fixed in the corresponding slit of the housing 2 when being press-fitted therein, and an extending portion 48 that extends from the housing fixing portion 47 to the front end portion 43. The first contact 41 also has an upper arm portion 49 and a lower arm portion 50 that extend substantially parallel to the extending portion 48. The upper arm portion 49 is connected at its intermediate part with the extending portion 48 through a connecting portion 51, while the lower arm portion 50 is connected at its root to the extending portion 48. Contact portions 52 and 53 are formed at ends of the upper and lower arm portions 49 and 50, respectively, so as to face each other.

Figure 4:
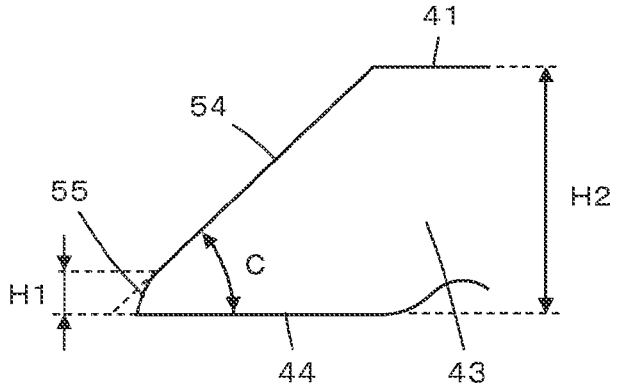
FIG. 4 is an enlarged diagram partially showing a front end portion of the first contact used in the connector according to the first embodiment.

A sloping surface 54 is formed at the front end portion 43 of the first contact 41 as illustrated in FIG. 4. The sloping surface 54 is inclined at a predetermined angle C with respect to the surface 44 to be mounted and faces forward of the first contact 41. The sloping surface 54 serves to guide a connection end of a connection target into the interior of the housing 2 when the connection target is inserted into the connector 1.

A cutout portion 55 is formed at an end portion of the sloping surface 54 by cutting away a part of the end portion within a range from the surface 44 to be mounted to a height H1. The cutout portion 55 is formed to have an inclined angle greater than the predetermined angle C of the sloping surface 54. The height H1 of the cutout portion 55 is set to be 0.1 mm or less so that the cutout portion 55 is fully covered by a solder fillet which is formed when the surface 44 to be mounted is soldered onto a solder pad of the mounting board. Due to providing such cutout portion 55, the first contact 41 can be manufactured by sheet metal stamping without creating burrs at the end portion of the sloping surface 54.

The first contact 41 may have a thickness of 0.08 mm, and a height H2 of the front end portion 43 may be about 0.25 mm, for instance.

The second contact 42 illustrated in FIG. 2 is also made of a flat metal member having conductivity as well as the first contact 41, and has a contact portion 56 formed at an end of an upper arm portion and a contact portion 57 formed at an end of a lower arm portion, whereas the front end portion of the second contact 42 is located behind the front end portion of the first contact 41, i.e., located closer to the rear opening 22 and there formed neither sloping surface 54 nor cutout portion 55 as provided for the first contact 41.

The first contacts 41 and the second contacts 42 as described above are held in the housing 2. An insertion section 23 of recess shape for receiving an inserted connection end of the connection target is formed at a deep portion of the interior of the housing 2 which communicates with the front opening 21, as illustrated in FIG. 2. The contact portion 52 of the first contact 41 and the contact portion 56 of the second contact 42 protrude from the ceiling portion of the insertion section 23 toward the interior thereof, and the contact portion 53 of the first contact 41 and the contact portion 57 of the second contact 42 protrude from the bottom of the insertion section 23 toward the interior thereof.

When the actuator 3 is operated to be rotated from the opening position where the upper side of the rear opening 22 is opened to the closing position where the upper side of the same is covered, a cam part 31 formed at the actuator 3 acts so that the upper arm portion 49 of the first contact 41 and the upper arm portion of the second contact 42 are subjected to stress and the contact portions 52 and 56 formed at the ends of the upper arm portions are forced to approach the facing contact portions 53 and 57 of the lower arm portions.

Also, the housing 2 includes a slope 24 that is smoothly continuous with the sloping surface 54 of the first contact 41 and is connected to the entrance of the insertion section 23.

Figure 5:
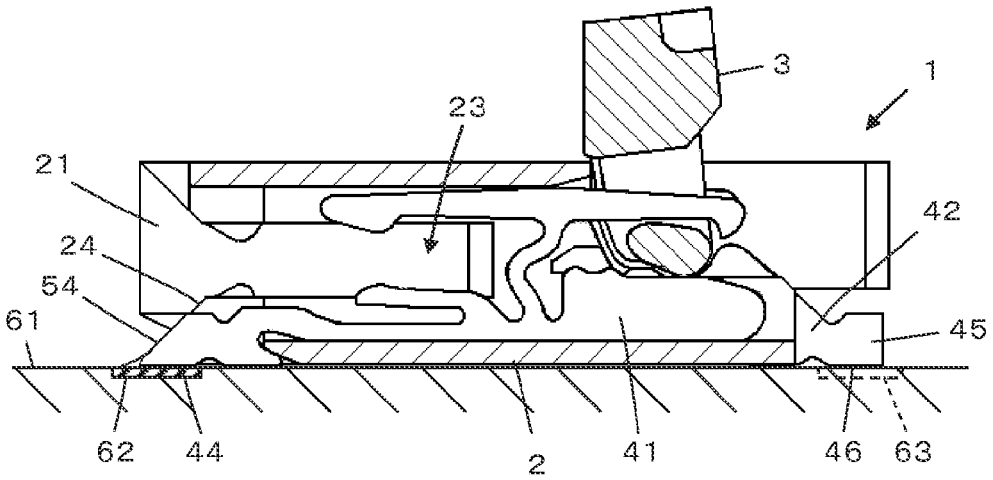
FIG. 5 is a cross-sectional view showing the connector according to the first embodiment mounted on a mounting board.

Shown in FIG. 5 is the state in which the connector 1 according to the first embodiment having the configuration as described above is mounted on a top surface of a mounting board 61.

An array of solder pads 62 and an array of solder pads 63 are formed on the to surface of the mounting board 61. The solder pads 62 correspond to the front end portions 43 of the first contacts 41 of the connector 1, and the solder pads 63 correspond to the rear end portions 45 of the second contacts 42. The surface 44 to be mounted of each first contact 41 is soldered on the corresponding solder pad 62, while the surface to be mounted 46 of each second contact 42 is soldered on the corresponding solder pad 63, so that the connector 1 is mounted onto the top surface of the mounting board 61.

Figure 6:
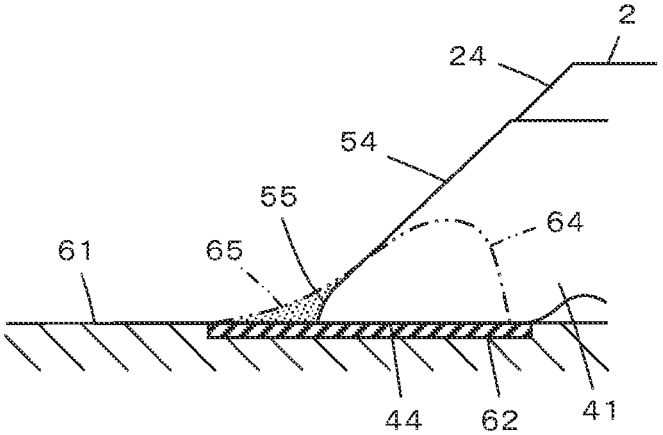
FIG. 6 is an enlarged cross-sectional view partially showing the front end portion of the first contact in the connector according to the first embodiment mounted on the mounting board.

The surfaces 44 to be mounted and 46 of the first and second contacts 41 and 42 are simultaneously soldered for mounting on the corresponding solder pads 62 and 63 by, for example, reflow soldering method, respectively. At this time, as illustrated in FIG. 6, a solder fillet 65 is formed from solder 64 used for mounting over a range from the intermediate portion of the sloping surface 54 of the first contact 41 to a surface of the solder pad 62 of the mounting board 61. The cutout portion 55 which is formed by cutting away in the range of height H1 of 0.1 mm or less from the surface 44 to be mounted of the first contact 41 is fully covered by the solder 64, the sloping surface 54 of the first contact 41 is smoothly connected to a surface of the solder fillet 65, and the surface of the solder fillet 65 is smoothly connected to the top surface of the mounting board 61.

The solder fillets 65 as described above are formed at mounted portions of all the first contacts 41 so that the solder fillets 65, the sloping surfaces 54 of the first contacts 41, and the slope 24 of the housing 2 constitute a guiding path extending from the top surface of the mounting board 61 to the entrance of the insertion section 23 of the housing 2 for guiding the connection target.

Subsequently, an operation of connecting a connection target to the connector 1 will be described.

Figure 7A:
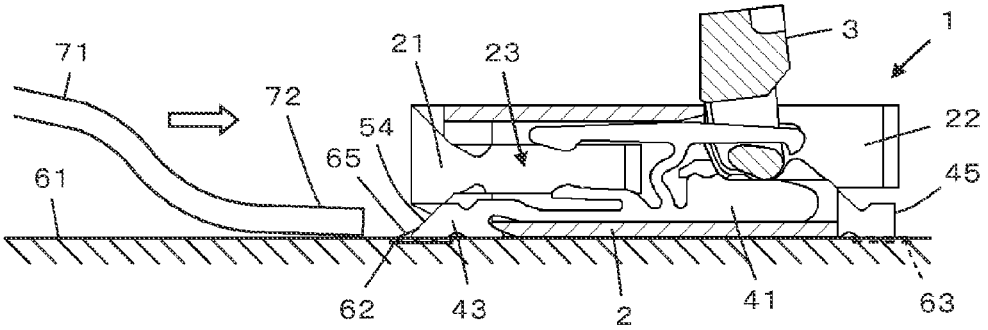
FIGS. 7A to 7C are diagrams showing an operation of inserting a connection target into the connector according to the first embodiment in a stepwise manner.

First, as illustrated in FIG. 7A, a connection end 72 of a sheet-shaped connection target 71 such as an FPC or an FFC is advanced toward the front opening 21 of the housing 2 along the top surface of the mounting board 61 in a state that the actuator 3 is in the opening position where the upper portion of the rear opening 22 is opened.

Although the front end portions 43 of the first contacts 41 protrude in the direction opposed to the advancing direction of the connection target 71 at the lower portion of the front opening 21 of the housing 2, the top surface of the mounting board 61 is smoothly connected to the surfaces of the solder fillets 65 and the surfaces of the solder fillets 65 are smoothly connected to the sloping surfaces 54 of the front end portions 43 of the first contacts 41, as described above.

Figure 7B:
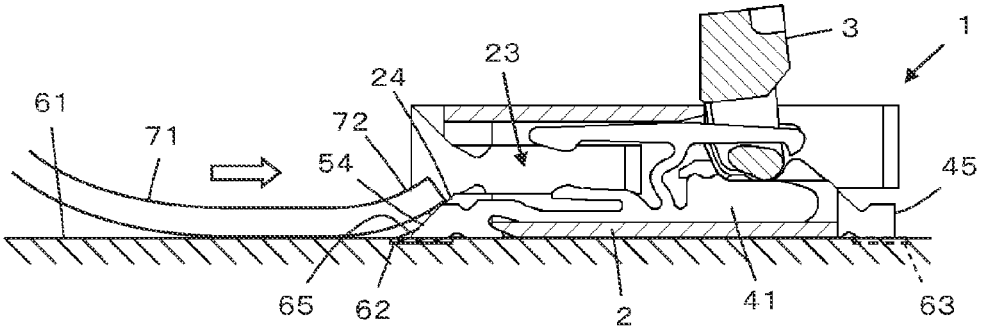

Consequently, when the connection end 72 of the connection target 71 reaches the lower portion of the front opening 21 of the housing 2, as illustrated in FIG. 7B, the connection end 72 is guided from the top surface of the mounting board 61 by the surfaces of the solder fillets 65 on the solder pads 62 and the sloping surfaces 54 of the first contacts 41 connected to the surfaces of the associated solder fillets 65, and thereby lifted up to upper portions of the sloping surfaces 54 of the first contacts 41 smoothly.

Figure 7C:
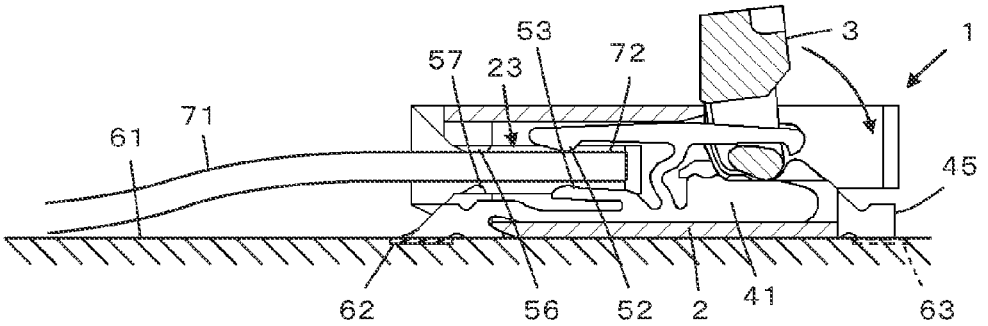

Since the sloping surfaces 54 of the first contacts 41 are smoothly connected to the slope 24 of the housing 2, by further advancing the connection target 71, the connection end 72 of the connection target 71 is guided from the upper portions of the sloping surfaces 54 of the first contacts 41 to reach the entrance of the insertion section 23 through the slope 24 of the housing 2, and then inserted into a deep area of the insertion section 23, as illustrated in FIG. 7C.

Upon rotating the actuator 3 from the opening position where the upper portion of the rear opening 22 is opened to the closing position where the upper portion of the rear opening 22 is covered, the cam part 31 of the actuator 3 acts so that the distance between the contact portions 52 and 53 of each first contact 41 and the distance between the contact portions 56 and 57 of each second contact 42 are forced to reduce, whereby these contact portions are electrically connected to corresponding connection terminals of the connection target 71, while the connection target 71 is held in the connector 1.

Thus, all the first contacts 41 to be mounted by soldering on the solder pads 62 of the mounting board 61 on a side of insertion of the connection target 71 have the sloping surfaces 54 at their front end portions 43 on the side of insertion of the connection target 71, and the lower half portions of the sloping surfaces 54 are smoothly connected to the surfaces of the solder fillets 65 while the upper portions of the sloping surfaces 54 are smoothly continuous with the slope 24 of the housing 2. Therefore, only by advancing the connection end 72 of the connection target 71 toward the front opening 21 of the housing 2 along the top surface of the mounting board 61, the connection target 71 can be inserted into the insertion section 23 of the connector 1 quite easily and smoothly to establish the electrical connection.

Since the first contacts 41 each have the sloping surface 54 and the sloping surface 54 is smoothly connected to the surface of the solder fillet 65, even when the connection target 71 is increased in width due to a great number of pins installed, the connection target 71 can be smoothly inserted into the insertion section 23 of the connector 1 without exhibiting deflection. Further, even when the connection target 71 is obliquely inserted into the connector 1, the connection end 72 of the connection target 71 is guided by the sloping surfaces 54 of the first contacts 41 and the solder fillets 65, whereby the connection target 71 can be smoothly inserted into the insertion section 23 of the connector 1.

It should be noted that, although the sloping surfaces 54 of the first contacts 41 are smoothly continuous with the slope 24 of the housing 2, in the case where the connection end 72 of the connection target 71 is configured to be adequately guided by the sloping surfaces 54 of the first contacts 41 to reach the entrance of the insertion section 23, it is not necessary to form the slope 24 at the housing 2.

Second Embodiment

In the first embodiment explained above, in order to avoid creating burrs in manufacturing the first contact 41 by sheet metal stamping, the cutout portion 55 is formed at the end portion of the sloping surface 54 of the first contact 41 by cutting away a part of the end portion within a range of the height H1 of 0.1 mm or less. However, the cutout portion 55 is not required as long as the first contact 41 can be manufactured without burrs.

Figure 8:
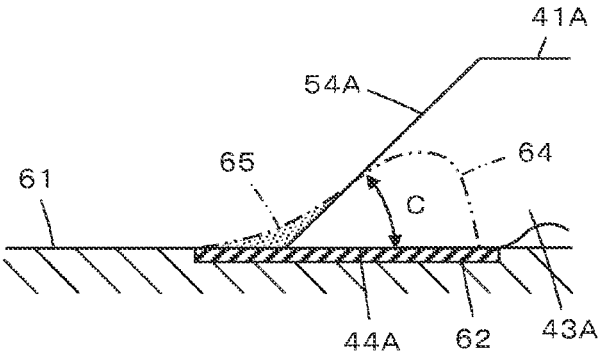
FIG. 8 is an enlarged cross-sectional view partially showing a front end portion of a first contact in a connector according to a second embodiment mounted on a mounting board.
Figure 9:
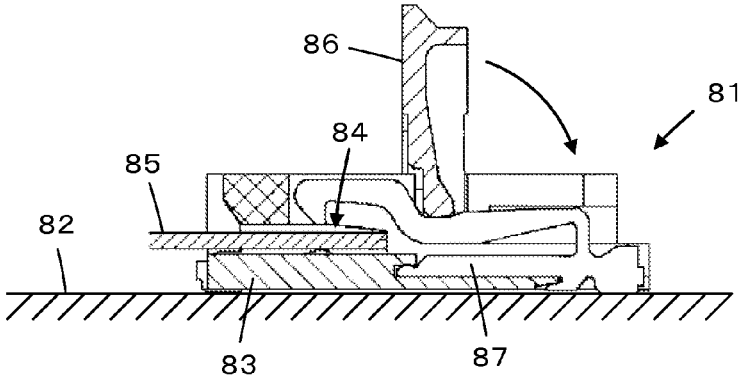
FIG. 9 is a cross-sectional view of a conventional connector.
Figure 10A:
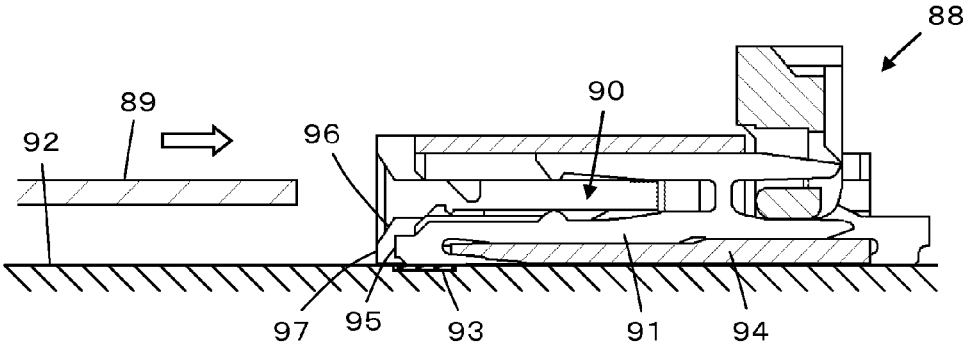
Conventional Art FIG. 10A
Figure 10B:
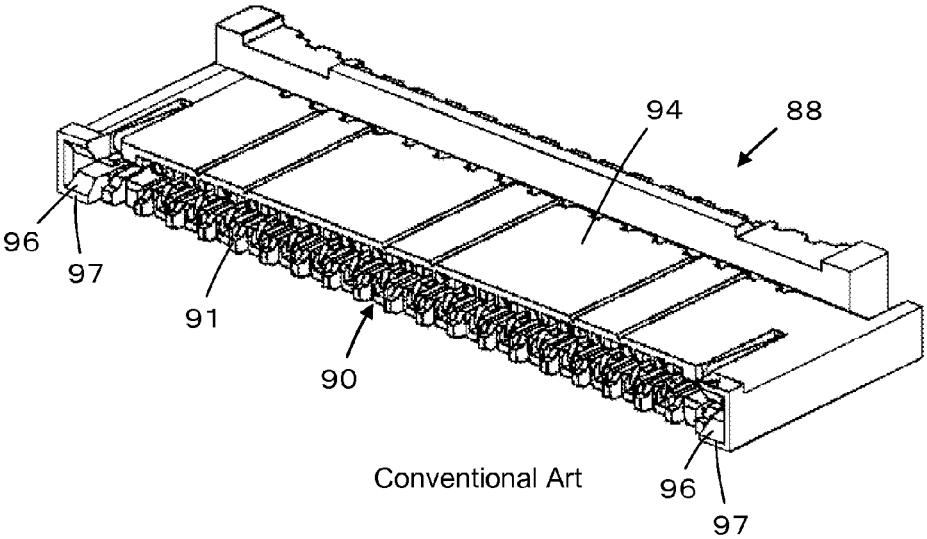
Conventional Art FIG. 10B

For instance, as illustrated in FIG. 8, a sloping surface 54A of a front end portion 43A of a first contact 41A is formed to be connected to a flat-shaped surface 44A to be mounted formed at the bottom of the front end portion 43A at the predetermined angle C.

With this configuration as well, when the surface 44A to be mounted of the first contact 41A is soldered on the solder pad 62, a solder fillet 65 is formed from solder 64 used for mounting over a range from the intermediate portion of the sloping surface 54A to the surface of the solder pad 62 of the mounting board 61 and the solder fillet 65 is smoothly connected to the sloping surface 54A. Therefore, as is the case with the first embodiment, only by advancing the connection end 72 of the connection target 71 along the top surface of the mounting board 61, the connection target 71 can be inserted into an insertion section of the connector quite easily and smoothly.

In the second embodiment, since the sloping surface 54A of the first contact 41A is connected to the surface 44A to be mounted at the predetermined angle C, even if the solder fillet 65 is not formed over a range from the intermediate portion of the sloping surface 54A to the surface of the solder pad 62 of the mounting board 61, the connection target 71 can be inserted into the insertion section of the connector smoothly only by advancing the connection end 72 of the connection target 71 along the top surface of the mounting board 61.

It should be noted that, although the connection target 71 is exemplified by the sheet-shaped flexible FPC and FFC, the invention should not be limited thereto. Even when a sheet-shaped rigid connection target is applied, the connection target can be inserted into an insertion section of a connector easily and smoothly only by advancing a connection end of the connection target along the top surface of a mounting board as well.

It should also be noted that this invention is applicable not only to so-called ZIF (zero insertion force) type connectors and LIF (low insertion force) type connectors in which a connection target is held with the use of the actuator 3 as illustrated in FIG. 1, but also to connectors of NON-ZIF type using no actuator, in other words, is applicable to a variety of types of connectors which allow a connection end of a connection target to be inserted into an insertion section.

What is claimed is:

1. A connector mounted on a top surface of a mounting board, comprising:

a housing having a front opening and an recess-shaped insertion section into which a connection end of a flexible sheet-shaped connection target is inserted through the front opening, a ceiling portion of the recess-shaped insertion section being closed by the housing; and a plurality of contacts held by the housing so as to extend in an insertion direction of the connection target and be aligned along a direction across the insertion direction of the connection target, wherein each of the plurality of contacts to be mounted by soldering on the top surface of the mounting board on a side of insertion of the flexible sheet-shaped connection target includes a front end portion protruding forward from the front opening of the housing, the front end portion having a surface of flat shape to be mounted on the top surface of the mounting board and a sloping surface which is inclined at a predetermined angle of less than 90 degrees with respect to the surface to be mounted for guiding the connection end of the connection target to the recess-shaped insertion section, the front end portion with the surface of flat shape to be mounted and the sloping surface protruding forward from the front opening of the housing, the sloping surface having a first end and a second end that is closer to the front opening than the first end, and the first end of the sloping surface is adjacent to the surface of flat shape, such that during an insertion of the flexible sheet-shaped connection target into the connector, when the connection end of the flexible sheet-shaped connection target comes contact with the first end of the sloping surface while in contact with the top surface of the mounting board, the connection end of the flexible sheet-shaped connection target is guided by the sloping surface and is inserted into the recess-shaped insertion section through the front opening.

2. The connector according to claim 1, wherein the first end of the sloping surface on the side of insertion of the connection target has a cutout portion that has a predetermined height from the surface to be mounted such that the cutout portion is fully covered by solder when the each of the plurality of contacts is mounted by soldering on the top surface of the mounting board.

3. The connector according to claim 2, wherein the predetermined height of the cutout portion is within a range to a height of 0.1 mm so as to have an inclined angle of greater than the predetermined angle with respect to the surface to be mounted.

4. The connector according to claim 2, wherein the predetermined height of the cutout portion from the surface to be mounted is less than a height of the sloping surface from the cutout portion to a top surface of the contact.

5. The connector according to claim 1, wherein the sloping surface is connected to the surface to be mounted at the predetermined angle.

6. The connector according to claim 1, wherein the sloping surface is smoothly connected to a surface of a solder fillet which is formed over a range from an intermediate portion of the sloping surface to the top surface of the mounting board when the surface to be mounted of each of the plurality of contacts is soldered on the top surface of the mounting board.

7. The connector according to claim 1, wherein the housing has a slope that is smoothly continuous with the sloping surface of each of the plurality of contacts and is connected to an entrance of the recess-shaped insertion section.

* * * * *